United States Patent [19]

Ito et al.

[11] Patent Number: 5,070,363

[45] Date of Patent: Dec. 3, 1991

[54] COUNTING SYSTEM FOR USE IN A COPYING MACHINE

[75] Inventors: Masazumi Ito; Yoichi Utsunomiya, both of Osaka, Japan

[73] Assignee: Minolta Camera Kabushiki Kaisha, Osaka, Japan

[21] Appl. No.: 311,979

[22] Filed: Feb. 17, 1989

Related U.S. Application Data

[62] Division of Ser. No. 137,187, Dec. 23, 1987, Pat. No. 4,897,697.

[30] Foreign Application Priority Data

Jul. 3, 1987 [JP] Japan ..... 62-167568

[51] Int. Cl.[5] ..... G03G 15/01; G03G 21/00

[52] U.S. Cl. ..... 355/206; 355/209; 355/326

[58] Field of Search ..... 355/4, 200, 210, 326, 355/327, 328, 206, 209

[56] References Cited

U.S. PATENT DOCUMENTS 3,914,043 10/1975 McVeigh ..... 355/4
4,579,443 4/1986 Abuyama et al. ..... 355/326 X
4,897,697 1/1990 Ito et al. ..... 355/326

FOREIGN PATENT DOCUMENTS 60-212778 10/1985 Japan .
61-203474 9/1986 Japan .

*Primary Examiner*—Fred L. Braun
*Attorney, Agent, or Firm*—Burns, Doane, Swecker & Mathis

[57] ABSTRACT

A copy machine includes an optical device for forming an electrostatic latent image of an original document on a photosensitive member, first and second developing apparatuses for developing the latent image on the photosensitive member and a setting system for setting a copying operation mode utilizing the first and second developing units in alternating and sequential operations during a single scanning operation of the optical device. An apparatus is provided for determining whether or not the color developer in the first and second developing units is the same and a prohibiting device prohibits the copying machine from copying through use of both developing units when the determining apparatus determines that the first and second developing units contain the same color developer.

17 Claims, 16 Drawing Sheets

| toner color | switch SW1 | switch SW2 |
|---|---|---|
| black | ON | ON |
| red | ON | OFF |
| yellow | OFF | ON |
| — | OFF | OFF |

A : BLACK COPY COUNT VALUE b : RED COPY COUNT VALUE

C : YELLOW COPY COUNT VALUE d : SIMUL TANEOUS COLOR COPY COUNT VALUE

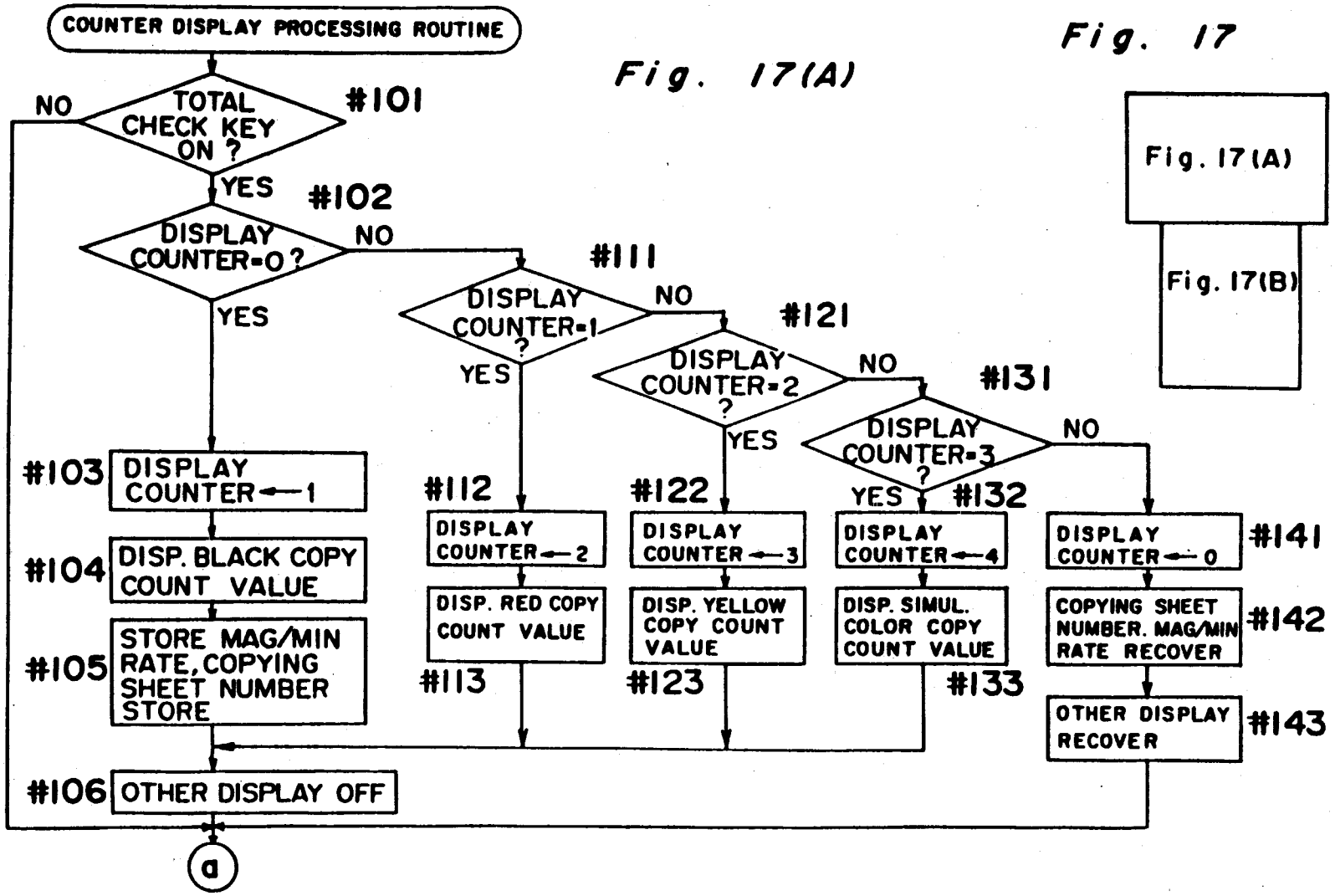
Fig. 17
Fig. 17(A)
Fig. 17(B)
COUNTER DISPLAY PROCESSING ROUTINE
#101
TOTAL CHECK KEY ON ?
YES
NO
#102
DISPLAY COUNTER=0 ?
YES
NO
#103
DISPLAY COUNTER ← 1
#104
DISP. BLACK COPY COUNT VALUE
#105
STORE MAG/MIN RATE, COPYING SHEET NUMBER STORE
#106
OTHER DISPLAY OFF
a
#111
DISPLAY COUNTER=1 ?
YES
NO
#112
DISPLAY COUNTER ← 2
#113
DISP. RED COPY COUNT VALUE
#121
DISPLAY COUNTER=2 ?
YES
NO
#122
DISPLAY COUNTER ← 3
#123
DISP. YELLOW COPY COUNT VALUE
#131
DISPLAY COUNTER=3 ?
YES
NO
#132
DISPLAY COUNTER ← 4
#133
DISP. SIMUL. COLOR COPY COUNT VALUE
#141
DISPLAY COUNTER ← 0
#142
COPYING SHEET NUMBER, MAG/MIN RATE RECOVER
#143
OTHER DISPLAY RECOVER

COUNTING SYSTEM FOR USE IN A COPYING MACHINE

This application is a divisional of application Ser. No. 137,187, filed Dec. 23, 1987, now U.S. Pat. No. 4,897,697.

BACKGROUND OF THE INVENTION

1. Field of the Invention

The present invention relates to a copying machine having two developing devices for color printing.

2. Description of the Prior Art

Copying machines have included two developing devices of different colors wherein monochrome color copying such as red color copying or yellow color copying can be carried out by selecting either one of the developing devices through operation of a key board on the copying machine.

Another copying machine has employed simultaneous color copying or one scan, two color copying by switching and using a plurality of developing devices in one exposure operation for printing a polychrome picture on one sheet of copying paper. According to the simultaneous color copying of such a copying machine, it is possible to print different colors on the left half portion and the right half portion of a picture and it is also possible to print a part of the picture with a different color in order to emphasize that part. One advantage of the proposed simultaneous color copying is that since the simultaneous color copying can be carried out in one copying operation, the step of setting the original document on the document platform and the step of operating the copying machine need only be performed once and thus, the copying time can be decreased.

One problem associated with the aforementioned simultaneous color copying machine is that if two developing devices of the same color are selected, the color pictures are printed twice with the same color. Accordingly, a needless developing operation if performed and the developing devices are unnecessarily worn.

SUMMARY OF THE INVENTION

One object of the present invention is to provide a copying machine in which unnecessary operation of the developing devices can be avoided when the simultaneous color copying operation utilizing the same color is selected.

BRIEF DESCRIPTION OF THE DRAWINGS

FIGS. 14–16, 17, 17(A), 17(B), 18 and 19 are flow charts showing a copying operation of the copying machine shown in FIG. 1.

DETAILED DESCRIPTION OF THE PREFERRED EMBODIMENT

Figure 1:
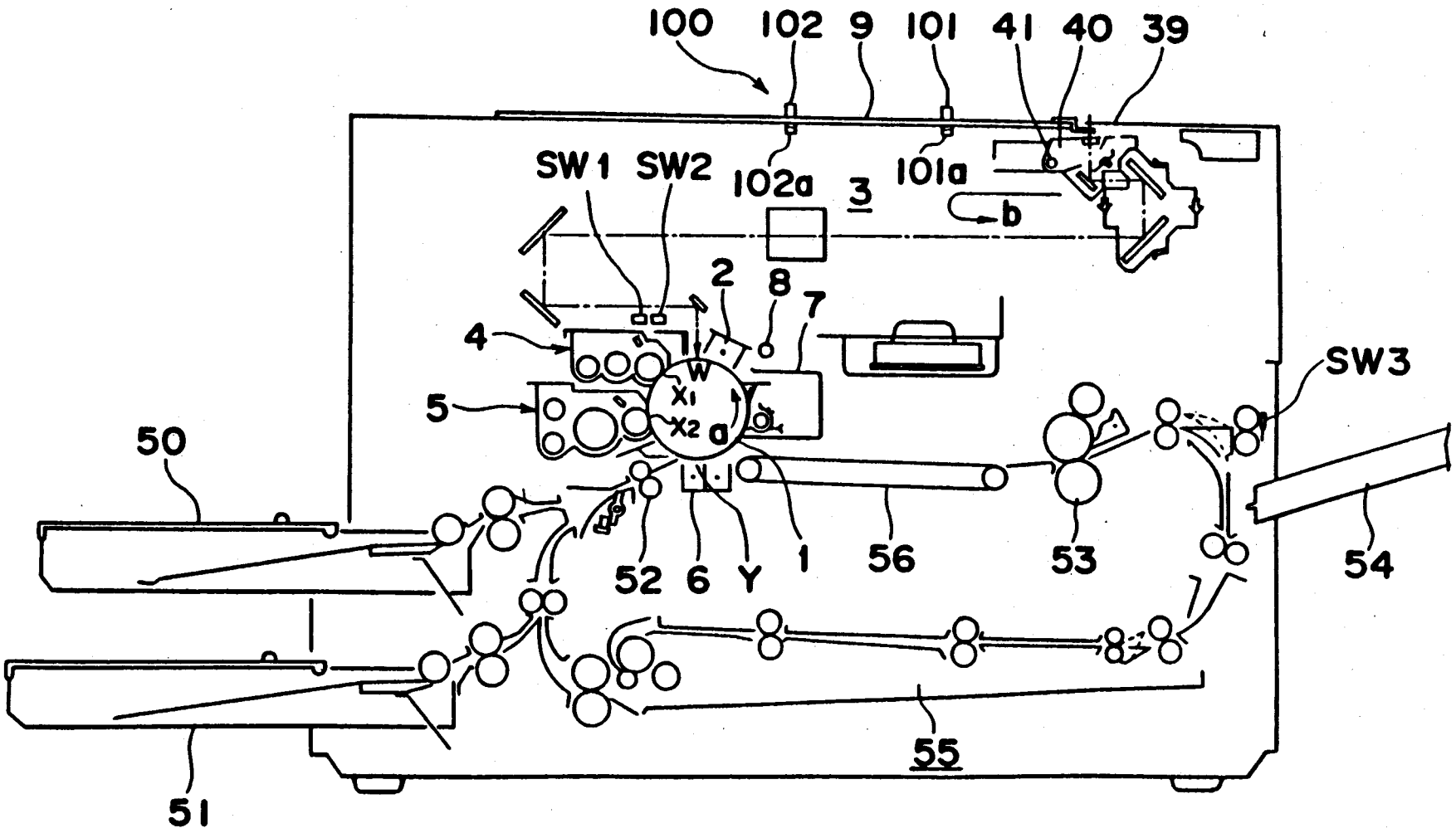
FIG. 1 is a schematic view showing an arrangement of a copying machine in which the present invention is applied.

FIG. 1 is a front sectional view showing a schematic structure of a copying machine comprising two developing units. Schematic structure of a copying machine is described with respect to a standard copying operation in which an image of an original document is reproduced as it is. First, under the condition that a photoconductor drum 1 is rotating in a direction shown by an arrow mark a, upon discharging of charger 2, electric charge is applied to the surface of the photoconductor drum 1.

Next, a scanner 40 having an exposure lamp 41 in an optical system 3 is moved in a direction shown by an arrow mark b, radiating light to an original document disposed on a platen 9 made of glass for placing an original document to be copied, and the reflection light thereof is projected onto the surface of the photoconductor drum 1 through an exposure point W via a lens system and various mirrors, whereby an electrostatic latent image corresponding to the image of the original document is formed on the surface of the photoconductor drum 1.

The electrostatic latent image is developed at a developing area X1 or X2 which oppose respectively a first developing unit 4 and second developing unit 5 arranged in turn by supplying toner from the developing unit 4 or 5.

On the other hand, a copying sheet is selectively fed from a sheet feeding device 50 or 51 to a transference area Y which opposes a transfer charger 6 at the same time of forming the toner image on the photoconductor drum 1 through a pair of timing rollers 52, where the toner image is transferred to the copying sheet, then the copying sheet to which the image is transferred is fed to the portion between a pair of fixing rollers 53 by means of a carrier belt 56 so that the toner image is fixed on the copying sheet by melting and the copying sheet on which the image fixed is transported to a sheet-discharge device 54.

In case a dual side copying mode is selected, the copying sheet is fed into a duplex device 55 from said fixing rollers 53 and after the copying sheet is turned over in the duplex device 55, the inverted copying sheet is fed into said transference area Y again. On the other hand, in the optical system 3 and the peripheral portion around the photoconductor drum 1, the second copying operation is executed in a similar way mentioned above, so that the toner image is transferred onto another surface of the copying sheet.

The remaining toner on the surface of the photoconductor drum 1 is cleaned off by a cleaning device 7 and remaining electric charge is erased by the radiation of light of an eraser lamp 8 so that the preparation for forming the next image is made.

In the copying machine mentioned above, there is further provided an image editing device 100. The developing units 4 and 5 and an operation panel 70 (see FIG. 11) are provided with a specific arrangement respectively so that, in addition to the standard copying operation, the simultaneous color control can be operated. In this arrangement, during the period of one time copying operation performed by one time scanning operation of the scanner 40, the image with two colors is formed by operating the two developing units 4 and 5 alternatively.

The first developing unit 4 and the second developing unit 5 are detachably attached to the copying machine, and the first and the second developing units 4 and 5 each containing developer of different color are exchangeable for a same type of a developing unit. In the present embodiment, each of the developing units 4 and 5 is exchangeable for a black developing unit for black color accommodating developer containing black toner and carrier and for a red developing unit for red color accommodating developer containing red toner and carrier, or for a yellow developing unit for yellow color accommodating developer containing yellow toner and carrier.

Therefore, there is a need for a judging means for judging the developing units for which color among black, red and yellow ones are attached to the copying machine as the first and second developing units 4 and 5.

In the present embodiment, the black developing unit is usually attached as the second developing unit 5 and any one of the developing units for black, red and yellow can be attached as the first developing unit 4.

There are two magnet switches SW1 and SW2 at the portion for attaching the first developing unit 4 in the copying machine. On the other hand, there are provided two magnets in the black developing unit, opposing to the switches SW1 and SW2. There is provided a magnet opposing to the switch SW1 in the red developing unit, and there is provided a magnet opposing to the switch SW2 in the yellow developing unit. These magnets are not shown.

Figures 10, 11:
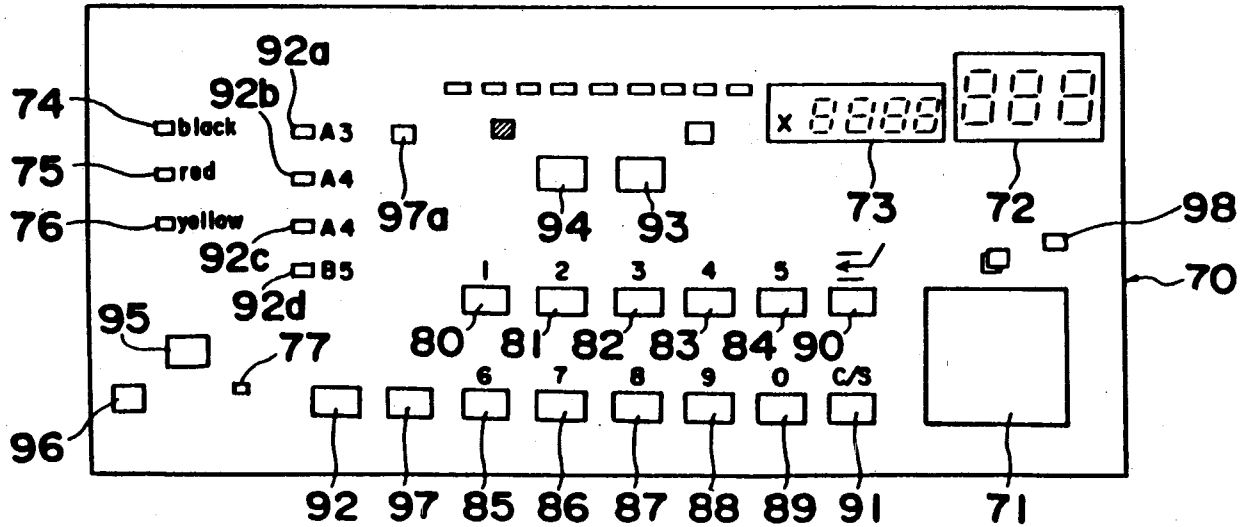
FIG. 10 is a view showing a relation between the operating condition of a magnet switch and a color of toner contained in the developing unit.
FIG. 11 is a plan view of the operation panel used in the copying machine shown in FIG. 1.

As shown in a color code table in FIG. 10, when the black developing unit is attached as the first developing unit 4, both of the switches SW1 and SW2 are turned on, when the red developing unit is attached as a first developing unit 4, only the switch SW1 is turned on, when the yellow developing unit is attached as the first developing unit 4, only the switch SW2 is turned on. When no developing unit is attached as the first developing unit, both of the switches SW1 and SW2 are turned off. The signals of the switches SW1 and SW2 turned on or off are applied to a control unit.

Figure 2:
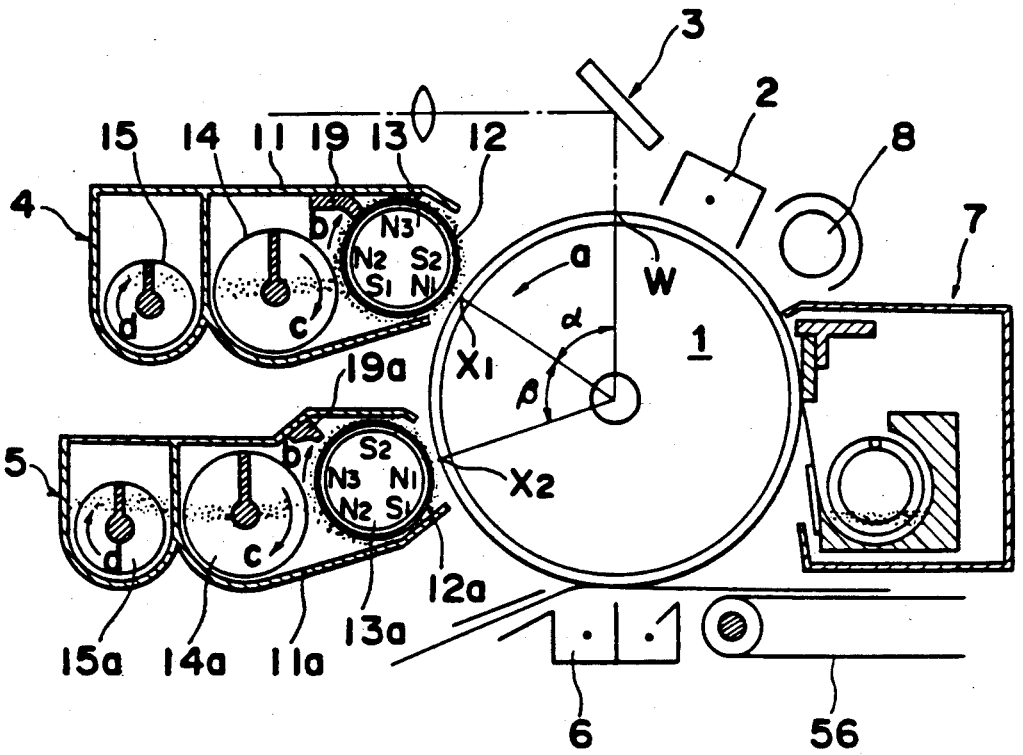
FIG. 2 is a partial enlarged cross sectional view showing peripherals of a photoconductor drum and a developing unit in the copying machine shown in FIG. 1.

As shown in FIG. 2, the developing units 4 and 5 have generally similar constitution, in a developing vessel 11, there are arranged a developing sleeve 12, a feeding roller 14 and a screw device 15 in turn from the side of the photoconductor drum 1.

The developing sleeve 12 is made of non-magnetic conductive material formed of cylindrical shape of 24.5 mm diameter with minute uneven patterns formed on the outer cylindrical surface by sand blast processing. The developing sleeve 12 (12*a*) opposes the developing area X1 (X2) of the photoconductor drum 1 with a developing gap of Ds (=0.6 mm), having rotation angles $\alpha$, $(\alpha+\beta)$, from the exposure point W to the developing areas X1, (X2) respectively set, wherein the rotation angle $\alpha$ is made 56° and $\beta$ is made 52°.

Figure 4:
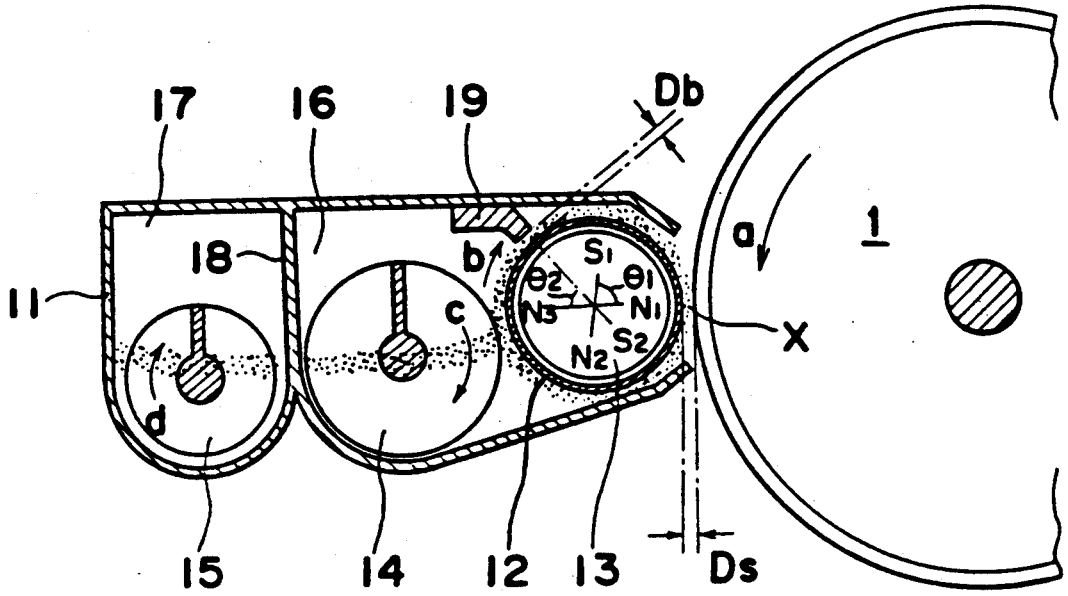

As shown in FIG. 4, in the rear portion of the developing area X of the developing sleeve 12, there is provided a head control member 19 with a head control gap Db of 0.4 mm wide in the upper portion on the inner surface of the developing vessel 11, opposing the surface of the developing sleeve 12.

In the developing sleeve 12, there is provided a magnet roller 13 having a plurality of magnets disposed to extend in the direction of the axis of said magnet roller 13. The magnetic fluxes of the magnet poles $N_1$ to $N_3$, $S_1$ and $S_2$ positioned in the outer surface of the magnets are respectively made as follows;

$N_1=1000$ G, $N_2$ and $N_3=500$ G, $S_1$ and $S_2=800$ G (herein G: gauss.

As shown in FIG. 4, the central portion of the magnet pole $N_1$ is situated at the position corresponding to the position rotated $\theta_1$ (=80°) in the clockwise direction from the central portion of the magnet pole $S_1$, and the central portion of the magnet pole $N_3$ is arranged at the position corresponding to the position rotated $\theta_2$(=40°) in the counter-clockwise direction from the portion opposing to the head control member 19 under the condition that the magnet pole $N_1$ opposes to the photoconductor drum 1.

Figure 3:
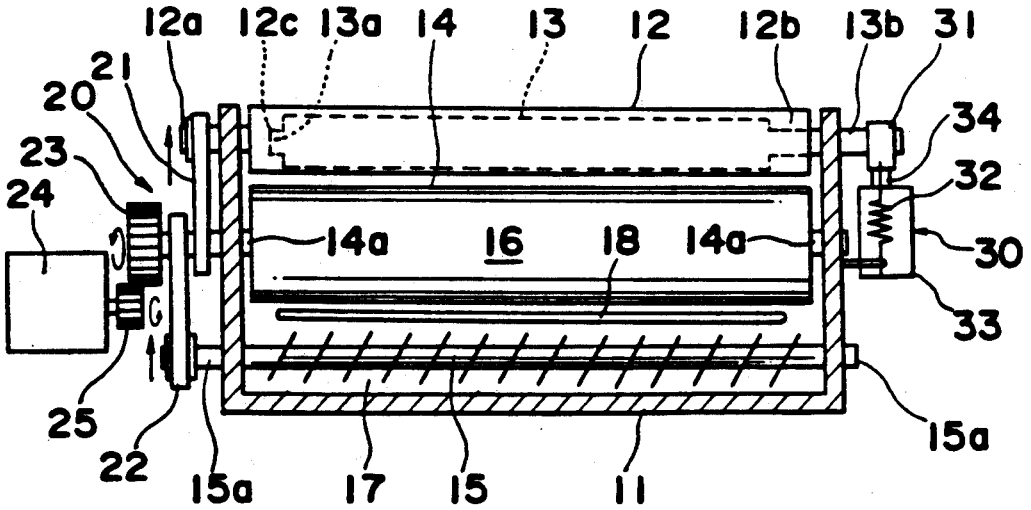
FIG. 3 is a plan cross sectional view of the developing unit shown in FIG. 2, FIGS. 4 and 6 are cross sectional views showing the operation of the developing unit shown in FIG. 2, FIGS. 5 and 7 front are views respectively showing the operation of a solenoid shown in FIG. 4 or FIG. 6.

As shown in FIG. 3, one end portion 13*a* of the shaft of the magnet roller 13 is supported at a shaft supporting concave 12*c* formed in the developing sleeve 12 and an other end portion 13*b* of the shaft is supported at a proper portion in the side wall of the developing vessel 11, so that the magnet roller 13 is rotatable by a predetermined angle $\theta_1$ (=40°) by means of a moving unit 30 to be described hereinafter.

On the other hand, a shaft supporting portion 12*b* of the right side of the developing sleeve 12 in FIG. 3 is supported by the shaft 13*b* of the magnet roller 13, and the shaft 12*a* of the left side is supported by the side wall of the developing vessel 11, whereby the developing sleeve 12 is rotatable by means of a driving unit 20.

The feeding roller 14 and the screw device 15 are respectively arranged in carrier paths 16 and 17 which are separated from each other by a partition wall 18, and the shaft 14*a* of the feeding roller 14 and the shaft 15*a* of the screw device 15 are respectively supported by the side walls of the developing vessel 11, whereby the feeding roller 14 and the screw device 15 are rotatable by means of the driving unit 20. The carrier paths 16 and 17 are joined together at both side portions of the developing vessel 11 as shown in FIG. 3.

The driving unit 20 of the developing units 4 and 5, the feeding roller 14 and of the screw device 15 will be explained as follows.

As shown in FIG. 3, the shaft 12*a* of the developing sleeve 12 is connected with the shaft 14*a* of the feeding roller 14 through a belt 21, and the shaft 14*a* of the feeding roller 14 is connected with the shaft 15*a* of the screw device 15 through a belt 22.

There is attached a gear 23 to the left end portion of the shaft 14*a* of the feeding roller 14 and the gear 23 is engaged with a driving gear 25 of a motor 24.

Therefore, when the motor 24 is driven so as to rotate the driving gear 25 in the direction shown by real line marks in FIG. 3, the gear 23 and the belts 21 and 22 are respectively driven in the direction shown by real arrow marks, so that the developing sleeve 12, the feeding roller 14 and the screw device 15 are respectively rotated in the directions shown by arrow marks b, c and d in FIG. 4. Herein, the developing sleeve 12 is set to rotate at 240 r.p.m..

Figure 5:
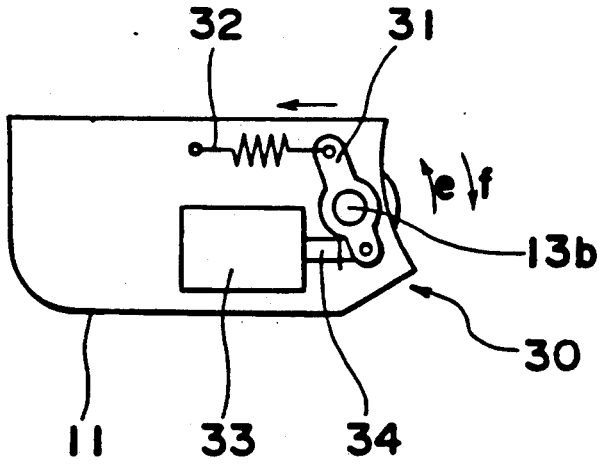
Figure 7:
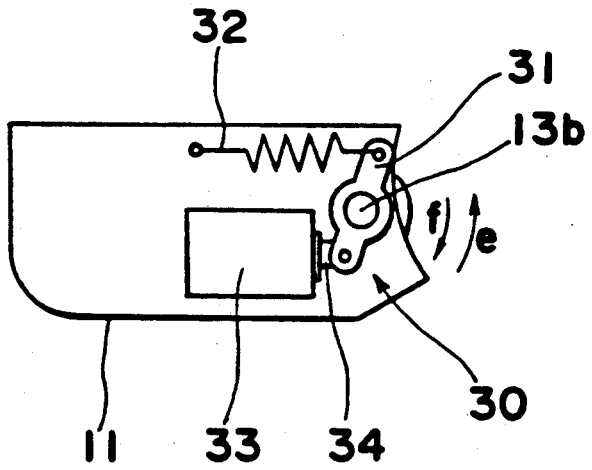

As shown in FIGS. 5 and 7, the driving unit 30 of the magnet roller 13 is composed of a lever 31, a spring 32 and a solenoid 33, and the lever 31 is fixed to the end portion of the shaft 13*b* of the magnet roller 13, and one end portion of the spring 32 fixed to the developing vessel 11 is attached to the upper end portion of the lever 31 so as to be always biased in the direction shown by an arrow mark e. A plunger 34 of the solenoid 33 is engaged with the lower end portion of the lever 31, and when the solenoid 33 is driven, the lever 31 is rotated in the direction shown by an arrow mark f against the applied force of the spring 32.

When the solenoid 33 is not operated, in other words, the lever 31 is settled in the condition shown in FIG. 5, the magnet pole $N_1$ of the magnet roller 13 opposes the photoconductor drum 1, and the magnet pole $N_3$ is settled at the position rotated at an angle $\theta_2$ (=40°) in the counter-clockwise direction from the portion opposing to the head control member 19 as shown in FIG. 4.

Figure 6:
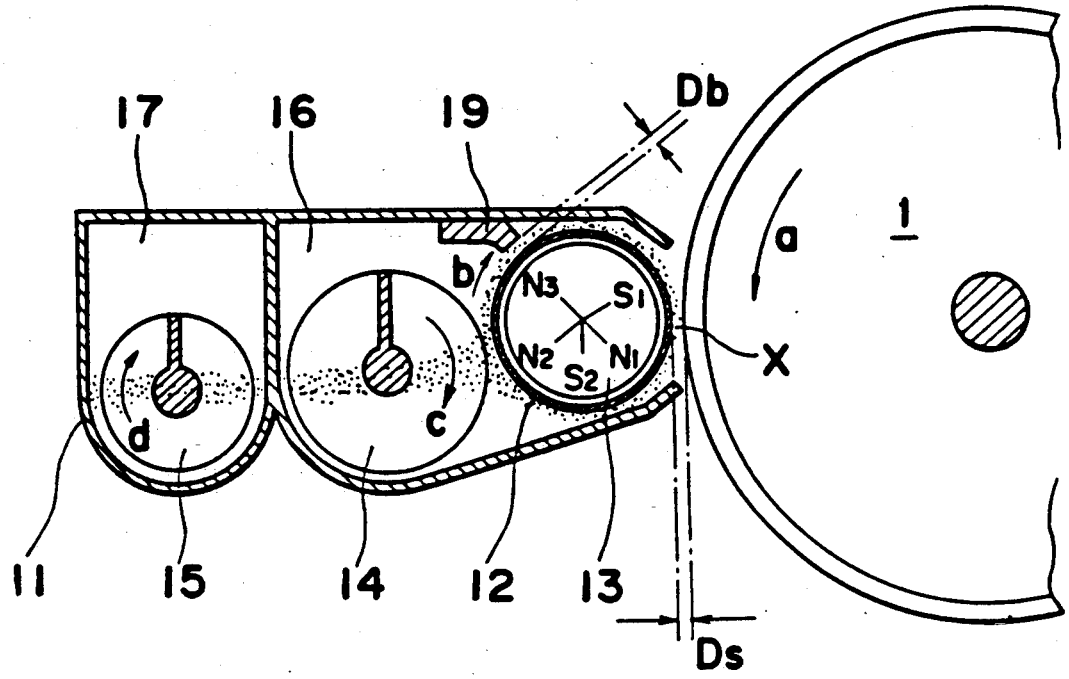

On the contrary, when the solenoid 33 is operated and the lever 31 is settled in the condition shown in FIG. 7, the magnet pole $N_3$ opposes the head control member 19 so that the middle portion between the magnet pole $N_1$ and the magnet pole $S_1$ opposes to the photoconductor drum 1 as shown in FIG. 6.

Figure 8:
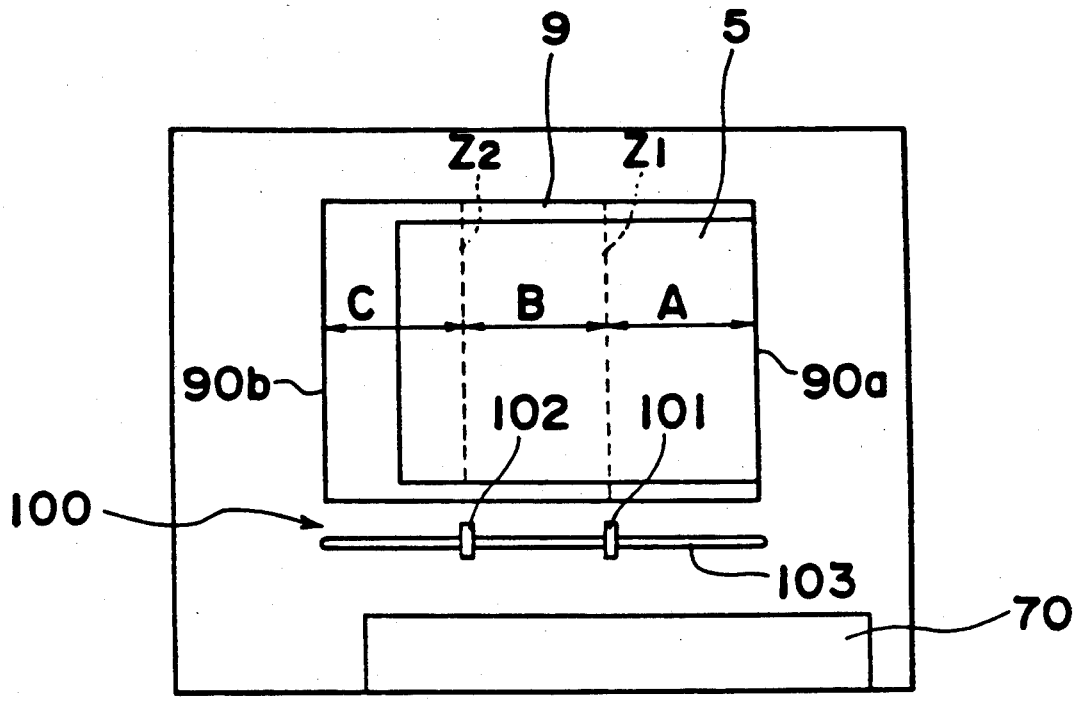
FIG. 8 is a plan view of the copying machine.
Figure 9:
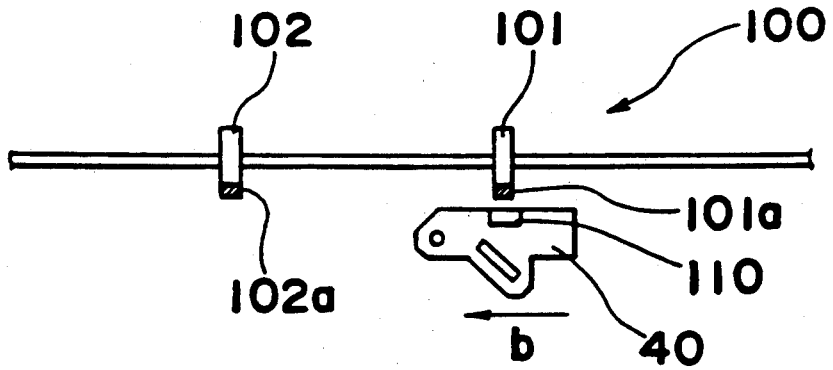
FIG. 9 is a partial enlarged front view showing a first lever and a second lever.

Next, referring to the image editing device 100 with reference to FIGS. 8 and 9, the first lever 101 and second lever 102 divide the original document disposing surface, which is the surface of the platen, in the direction of the motion of the scanner (in the direction shown by the arrow mark b) so as to indicate the developing area and the reproduction color thereof, and the first and second levers 101 and 102 are slidably attached to the guide slot 103 which is formed along the scanning direction of the scanner 40 in the side portion of the platen 9, and there are provided magnets 101*a* and 102*a* respectively at the under portions of the first and second levers 101 and 102 inside the copying machine.

Under the condition that each of the first and second levers 101 and 102 is set as shown in FIG. 8, the area A is indicated from the edge portion 90*a* of the platen 9 to the dotted line $Z_1$ corresponding to the first lever 101 and the area B is indicated from said dotted line $Z_1$ to the dotted line $Z_2$ corresponding to the second lever 102 and the area C is indicated from said dotted line $Z_2$ to the rear edge portion 90*b* of the platen 9, and the areas A and C are indicated as the areas to be copied in black and the area B is indicated as the area to be copied in red or yellow.

Figure 12:
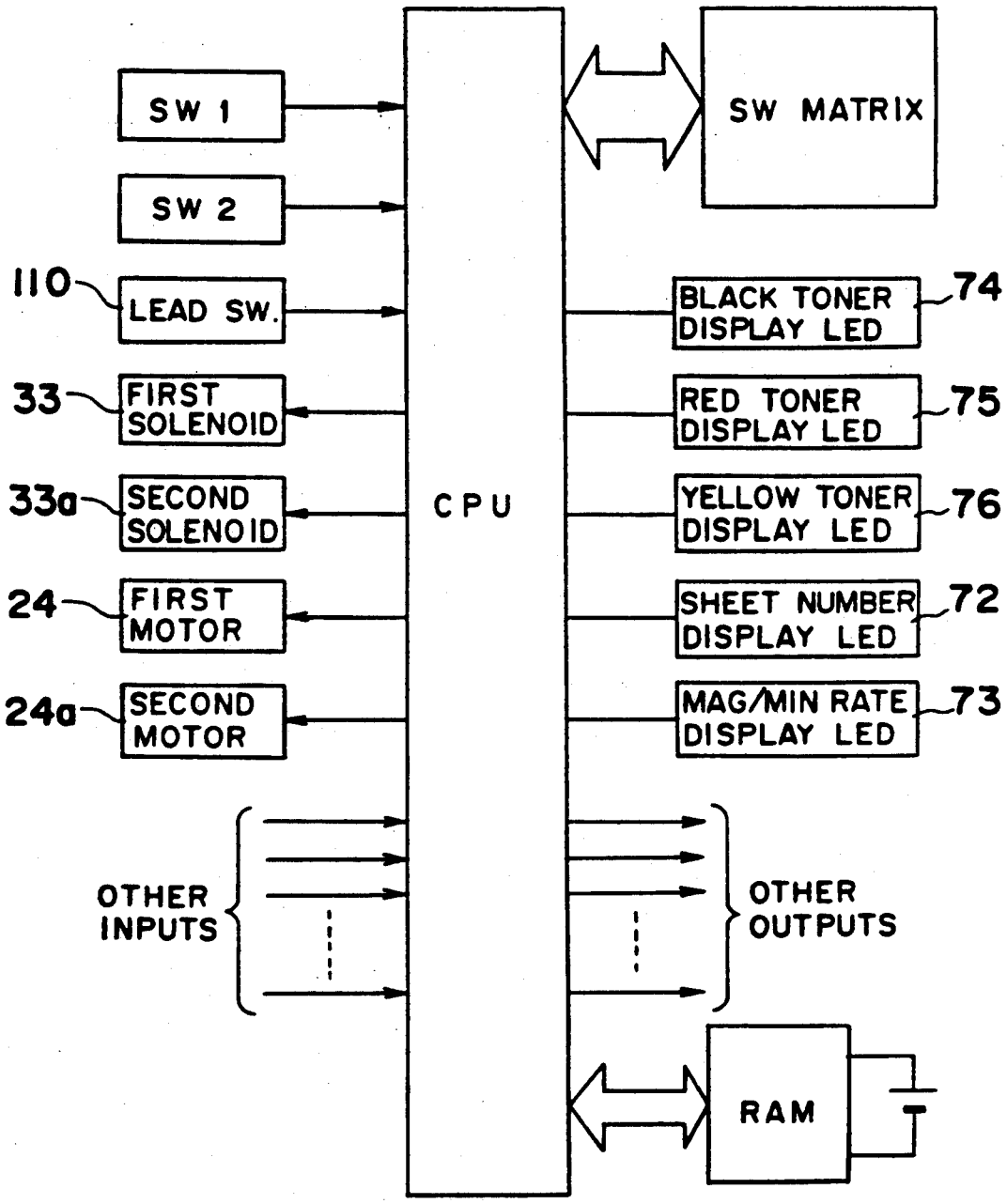
FIG. 12 is a block diagram showing a control unit used in the copying machine shown in FIG. 1.

On the other hand, in the scanner 40 of the optical system, there is provided a lead switch 110 for detecting the magnets 101*a* and 102*a* and thereby transfering the signals into a control unit as shown in FIG. 12.

Referring to FIG. 11 showing the operation panel 70 in the copying machine, reference numeral 71 denotes a print key, numeral 72 a sheet number display unit LED for displaying the number of copied sheets, numeral 73 a magnification or minification (referred to as MAG/-MIN) rate display unit LED for displaying the MAG/-MIN rate of the copied image to the original document image, and these display units LED 72 and LED 73 also display the count values of various kinds of the counters to be described later.

Reference numerals 74 to 76 denote toner color display units LED which display respectively black, red and yellow colors. Numeral 77 denotes a toner empty display unit LED for displaying the empty condition of the toner. Numeral 80 to 89 denote ten keys comprising 0 to 9 keys, numeral 90 denotes an interruption key for ordering the interruption of the copying operation, numeral 91 denotes a clear stop key C/S, numeral 92 denotes a sheet selecting key, numerals 92*a* to 92*d* denote sheet size selecting display units LED for displaying the sheet sizes A3, B4, A4 and B5 respectively, numerals 93 and 94 denote respectively an up key and a down key for controlling the density of the image of the copied sheet.

Reference numeral 95 denotes a selection key for selecting the first developing unit 4 and the second developing unit 5, numeral 96 denotes a total check key, numeral 97 denotes a simultaneous color selection key for selecting the simultaneous color, numeral 97*a* denotes a simultaneous color displaying unit LED showing the condition that the simultaneous color mode is selected, numeral 98 denotes an all reset key.

FIG. 12 shows a block diagram of the control unit, wherein the signals of the switches SW1 and SW2 and other signals are inputted to the central processing unit (referred to as the CPU hereinafter). The solenoids 33 and 33*a* of the first and the second developing unit, the first and the second developing unit motors 24 and 24*a*, and various kinds of display units LED 72 to LED 76 are connected to the output terminals of the CPU. In addition, a switch matrix including of the various kinds of key switches on the operation panel 70 and a non-volatile RAM (random access memory) are connected to CPU. The non-volatile RAM is partially used by the copying counters for black, red, yellow and simultaneous color copying operations.

Figure 13:
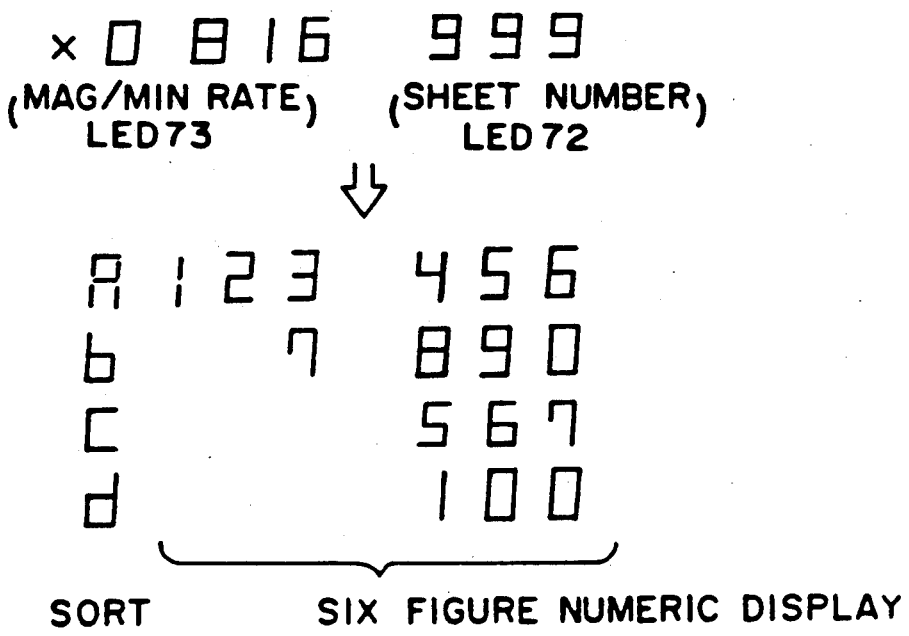
FIG. 13 is a schematic diagram showing an example of the copying counting values displayed by a magnification/minification rate display unit LED and by a sheet number

FIG. 13 shows a display example of the count values of the various kinds of the copying counter, which is displayed on the display units LED 72 and LED 73.

As shown in FIG. 13, one of the alphabetic letters 'A', 'b', 'c' and 'd' is displayed on the most significant figure of the four figures of the MAG/MIN rate display unit LED 73 which indicates what sort of count value is to be displayed. The lower three figures of the MAG/-MIN display unit LED 73 and the three figures of the sheets number display unit 72 are integrally used as a serial six figures display unit. The segment type display elements composing the sheets number display unit LED 72 and the MAG/MIN rate display unit LED 73 are driven by means of a known driving circuit (not shown) which is controlled by a central processing unit (referred to as CPU hereinafter).

Figure 20:
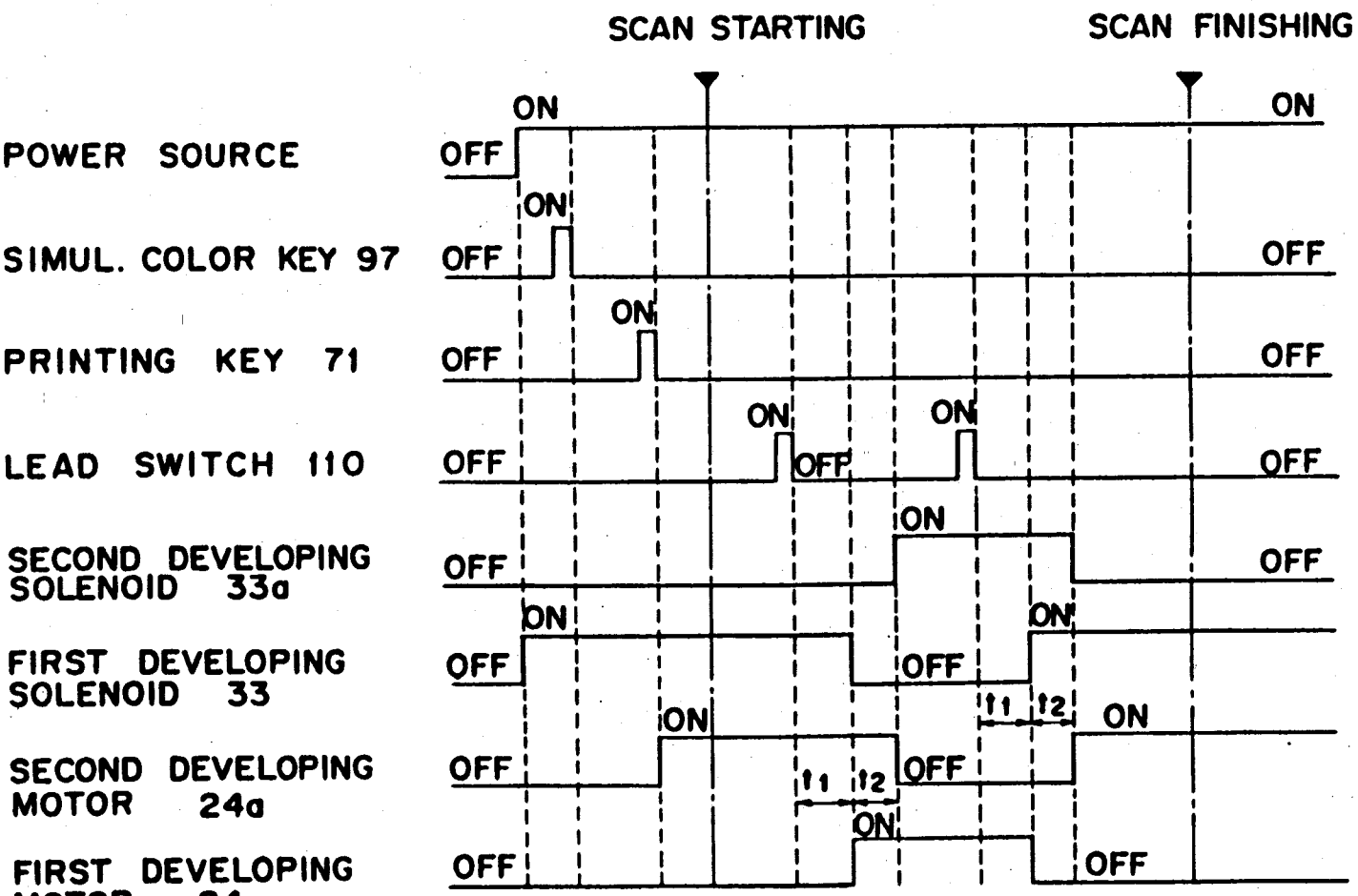
FIG. 20 is a timing chart showing an operating condition of the developing unit in the simultaneous color copying operation.

Next, the copying operation in the simultaneous color mode will be explained with reference to a timing chart shown in FIG. 20, wherein the components contained in the second developing unit 5 are distinguished by a character 'a' following to the reference numerals.

First, when a main switch (not shown) of the copying machine is turned on and power is supplied to the copying machine, the middle portion between the magnet pole $N_1$ and the magnet pole $S_1$ in the first developing unit 4 opposes to the portion X1 of the photoconductor drum 1 and the magnet pole $N_1$ in the second developing unit 5 opposes to the portion X2 of the photoconductor drum 1 as shown in FIG. 2.

Under this condition, when the print key 71 is turned on, the second developing unit 5 containing the black toner is automatically driven so as to perform the standard copying operation. When the simultaneous color selection key 97 is turned on, the copying machine is set in the condition capable of performing the simultaneous color copying operation. However, in case the simultaneous color selection key 97 is turned on during the copying operation, the simultaneous color copying operation is not executed.

When the simultaneous color selection key 97 is turned on, the copying mode is changed from the standard copying mode to the simultaneous color copying mode.

Under this condition, the first lever 101 and the second lever 102 are slid along the sliding slot 103, thereby setting the areas A and C of the black copy and setting the area B of the color copying as shown in FIG. 8.

The first and the second levers 101 and 102 are enabled only when the simultaneous color copying mode is set, however, each of the levers 101 and 102 is disabled when the other copying mode is selected.

Under the condition that the simultaneous color copying mode is set as mentioned above, when an original document is placed on the platen 9 and the print key 71 is turned on as shown in FIG. 8, the developing motor 24*a* of the second developing unit 5 is started and the developing sleeve 12*a*, the feeding roller 14*a* and the screw device 15*a* are rotated in the direction shown by the arrow marks b, c and d respectively.

By the operation mentioned above, the developer agent including black toner, which is accommodated in the developing vessel 11*a*, is mixed and stirred by the rotations of the feeding roller 14*a* and the screw device 15*a* and is circularly transported in the carrying paths 16*a* and 17*a*, so that a part of the developer is fed to the surface of the developing sleeve 12*a* through the rotation of the feeding roller 14*a*, whereby magnetic brushes are formed on the surface of the developing sleeve 12*a*.

The thickness of the magnetic brushes are adjusted by passing through the space of the head control gap Db between the head control member 19*a* and the developing sleeve 12*a* by the rotation of the developing sleeve 12*a* so that the the adjusted magnetic brushes are serially fed to the developing area X2, whereby it becomes ready to develop the electrostatic latent image on the surface of the photoconductor drum 1.

Upon turning on the print key 71, the scanner 40 is moved in the direction shown by the arrow mark b in FIG. 1, radiating light onto the original document situated on the platen 9. The reflection light from the original document is radiated onto the surface of the photoconductor drum 1 through the exposure point W, whereby the electrostatic latent image is formed and the development of the electrostatic latent image is made by means of the second developing unit 5 first.

Next, when the signal of the magnet 101*a* of the first lever 101 is detected by the lead switch 110 of the scanner 40 (see FIG. 9), the lead switch 110 applies the signal to the control unit.

At this point, the electrostatic latent image corresponding to the boundary line $Z_1$ between the areas A and B where the copy is changed from the black to the colored (yellow and red) is situated at the exposure point W on the surface of the photoconductor drum 1. In the period of the time $t_1$ (=0.22 sec.) during which the position of the electrostatic latent image corresponding to the boundary line $Z_1$ is moved from the exposure point W to the developing area X1 of the first developing unit 4, only the second developing unit 5 is continually operated.

When the position of the electrostatic latent image corresponding to the boundary line $Z_1$ reaches the developing area X1 after the lapse of the time $t_1$ from the time of turning on the lead switch 110, the first developing motor 24 is turned on and the solenoid 33 of the first developing unit 4 is turned off.

Thus, in a similar way to the second developing unit 5, the first developing unit 4 is set in the condition as shown in FIGS. 4 and 5, so that the developing sleeve 12, the feeding roller 14 and the screw device 15 are rotated respectively in the directions shown by the arrow marks b, c and d, whereby the magnetic brushes are formed on the surface of the developing sleeve 12 so as to set the condition capable of developing the electrostatic latent image on the surface of the photoconductor drum 1. Then the red or yellow color toner is fed to the electrostatic latent image corresponding to the area B from the first developing unit 4.

Next, after the lapse of the time $t_2$ from the time of starting the first developing motor 24, in other words, after the lapse of the time t (=0.2 sec.) during which the boundary line $Z_1$ of the electrostatic latent image is moved from the first developing area X1 to the second developing area X2, the motor 24*a* of the second developing unit 5 is turned off and the solenoid 33*a* of the second developing unit 5 is turned on. The second developing unit 5 is set in the condition as shown in FIGS. 6 and 7, so that the middle portion between the magnet pole $N_1$ and the magnet pole $S_1$ opposes to the surface of the photoconductor drum 1 at the portion X and the rotating operations of the developing sleeve 12, :he feeding roller 14 and the screw device 15 are stopped so as to finish the developing operation of the area A by using the black toner.

When the scanner 40 is further moved to the boundary line $Z_2$ between the area B and the area C, which is the position corresponding to the second lever 102, the lead switch 110 detects the magnet 102*a* and is turned on again, generating the signal to the control unit. At this time, the electrostatic latent image corresponding to the boundary line $Z_2$ is situated at the exposure point W.

After the lapse of the time $t_1$ from the time of turning on the lead switch 110, in other words, when the position of the electrostatic latent image corresponding to the boundary line $Z_2$ mentioned above reaches to the first developing area X1, the first developing motor 24 is turned off and the solenoid 33 of the first developing unit 4 is turned on so as to finish the red or yellow color development of the area B.

Furthermore, after the lapse of the time $t_2$, in other words, when the position of the electrostatic latent image corresponding to the boundary line $Z_2$ is moved from the first developing area X1 to the second developing area X2, the second developing motor 24*a* is turned on and the second developing solenoid 33*a* is turned off so as to start the black development of the area C. The developing operation by using the black toner is continued till the scanning operation is finished, so that the black development of the area C is completed.

By the operations mentioned above, the developing color is changed from black to red or yellow and furthermore changed to black in the period from the time of starting the scanning operation to the time of the finishing thereof so that the two color copying development can be obtained.

Next, the control operation of the control unit of the copying machine is explained with reference to flow charts shown in FIGS. 14 to 19.

Figure 14:
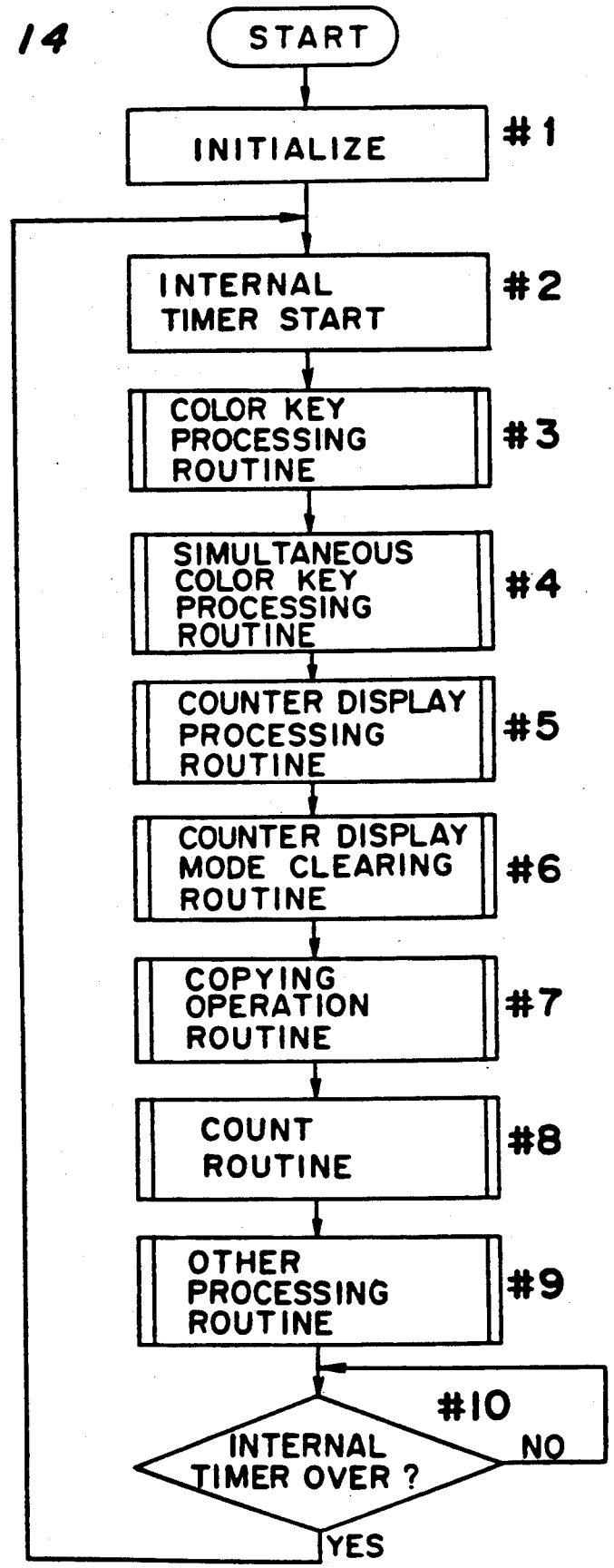

FIG. 14 shows a flow chart of a main routine controlling the whole part of the copying machine.

When the power source of the copying machine is turned on, the control unit is initialized and various kinds of modes are set in the standard mode and default values as various kinds of data are set in step #1.

In step #2, the operation of an internal timer for defining a predetermined time for one routine is started. In step #3, a color key processing routine is performed, and in step #4, a simultaneous color processing routine is performed. In step #5, a counter display processing routine for displaying the count values by means of the display units LED 72 and LED 73 is performed.

In step #6, a counter display mode clear routine is performed. In step #7, a copy operating routine is performed and the standard copying operation or the simultaneous color copying operation is performed. In step #8, a count routine counting the time of the operations of each of the developing units 4 and 5 is performed. In step #9, other processing routines are performed, and it is judged next in step #10 whether or not the operation of the internal timer started in the step #2 is finished. In the case the operation of the timer is finished, the program goes back to the step #2 again. In the case the operation of the timer is not finished yet, the program waits.

Figure 15:
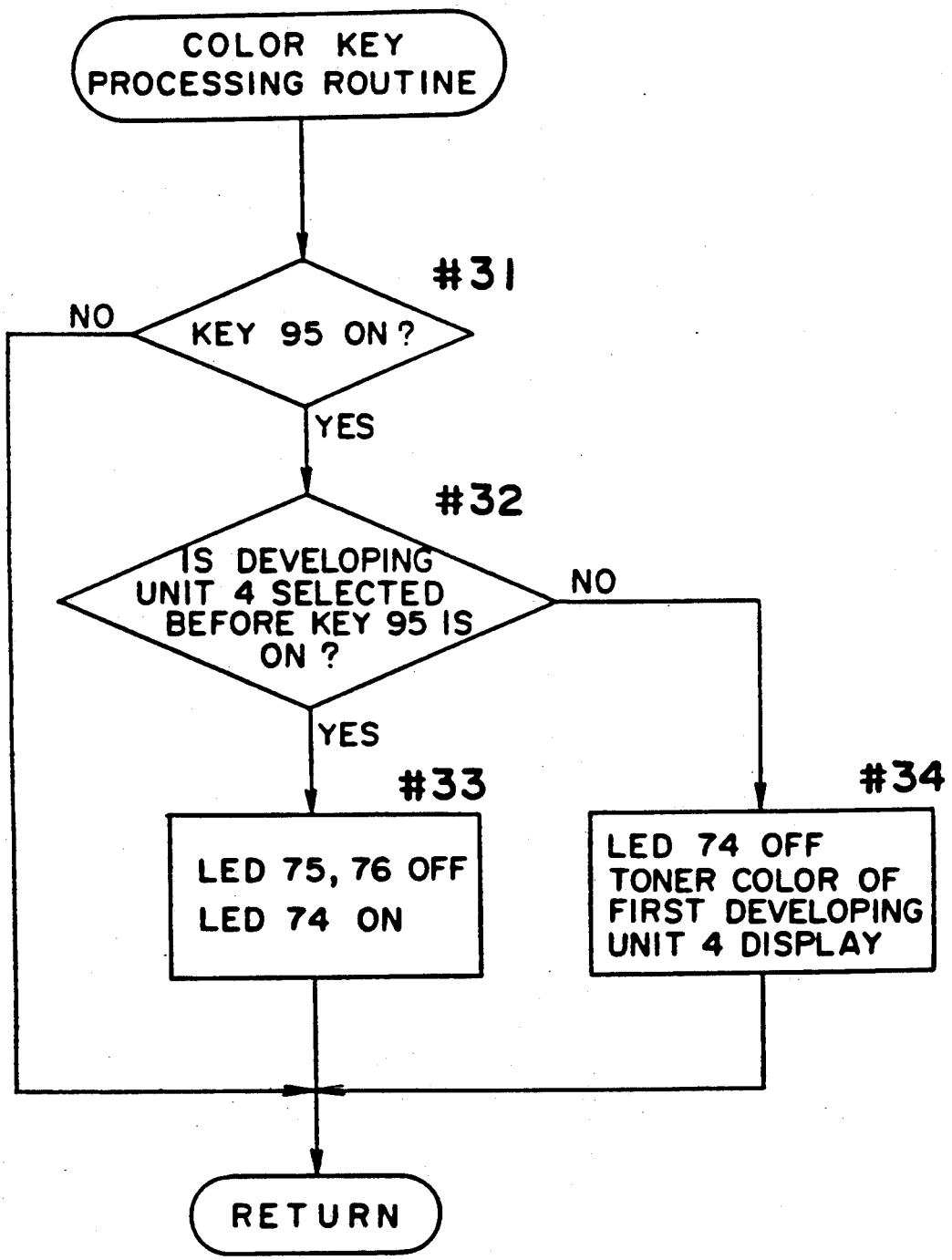

FIG. 15 shows a flow chart showing a color key processing routine.

It is judged in step #31 whether or not the developing unit selecting key 95 is turned on, and in the case the selecting key 95 is not turned on (in the case of 'No'), the program returns, and in the case the selecting key 95 is turned on (in the case of 'Yes'), the program goes to step #32. In the step #32, it is judged whether or not the first developing unit 4 is already selected before the developing unit selecting key 95 is turned on in the step #31. In case of 'Yes', the LED 75 for indicating red toner and LED 76 for indicating yellow toner are both turned off and the display unit 74 for the black toner is turned on in step #33. In case of 'No', the LED corresponding to the toner color contained in the developing unit attached as the first developing unit 4 is turned on in step #34.

The toner color of the first developing unit 4 is judged according to the color code table shown in FIG. 10 on the basis of the 'on'/'off' signal of the switches SW1 and SW2, which is inputted to the control unit.

As described above, in case the selecting key 95 is turned on by executing the color key processing routine on the condition that the LED 74 for displaying black toner is turned on, the LED 75 for indicating red toner or LED 76 for indicating yellow toner, corresponding to the toner color contained in the developing unit attached as the first developing unit 4, is turned on.

On the contrary, in case the selecting key 95 is turned on under the condition that the LED 75 for indicating red toner or LED 76 for indicating yellow toner is turned on, the display unit LED 74 for indicating black toner is turned on.

Figure 16:
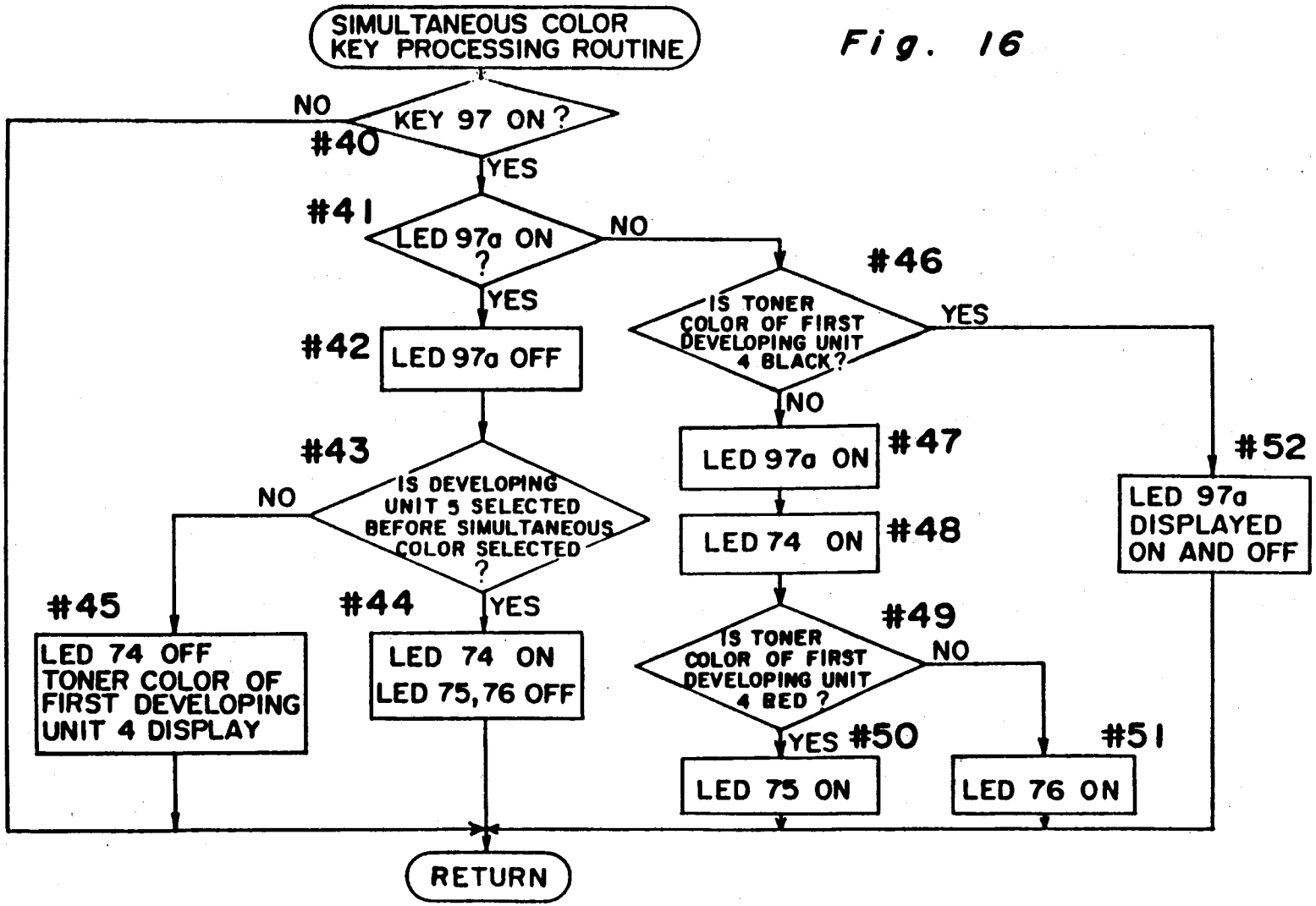

FIG. 16 shows a flow chart showing the simultaneous color key processing routine.

It is judged in step #40 whether or not the simultaneous color selecting key 97 is turned on, and in case of 'No', the program returns, and in case of 'Yes', the program goes to step #41 and it is judged whether the LED 97a of the simultaneous color display unit is turned on or off.

In the case the LED 97a is turned on in step #41, the LED 97a is once turned off in the next step #42. Then, it is judged in step #43 whether or not the second developing unit 5 has been already selected before the simultaneous color selecting key 97 is turned on. In case of 'Yes', the program goes to step #44 so that the LED 74 for indicating black toner is turned on and the LED 75 for red toner or LED 76 for yellow toner is turned off. In case of 'No', the program goes to step #45 and the LED 74 for black toner is turned off so as to display the toner color of the first developing unit 4.

The toner color of the first developing unit 4 is judged according to the color code table shown in FIG. 10 on the basis of the on/off signal of the switches SW1 and SW2, which is inputted to the control unit.

In the case it is judged in step #41 that the LED 97a is turned off, the program goes to step #46 and it is judged whether or not the toner color of the first developing unit 4 is black. In the case the toner color of the first developing unit 4 is black (in case of 'Ye' in step #46), since the toner color of the second developing unit 5 is also black, the simultaneous color development is prohibited so that the processing routines below step #47 are not performed. That is, the program goes to step #52 and the LED 97a is turned on and off, thereby warning that the simultaneous color development is disabled.

In case of 'No' in step #46, the program goes to step #47 and the LED 97a is turned on in order to set the simultaneous color copy mode, and in the next step #48 the display unit LED 74 for black development is turned on, wherein the black is one of the two simultaneous color copy.

Next in step #49, it is judged, on the basis of the on/off signal inputted through the switches SW1 and SW2, whether or not the toner color of the first developing unit 4 is red, and in case of red, the program goes to step #50 and the display unit LED 75 for red development is turned on. On the contrary, in the case it is judged that the developing unit for yellow color containing yellow toner is attached as the first developing unit 4, the program goes to step #51 and the display unit LED 76 for yellow development is turned on.

That is, upon performing the processing routines in steps #46 to #52, in the case the developing unit 4 containing black toner is set, the simultaneous color copying operation is prohibited, and displays the warning that the simultaneous color copying operation is disabled and in the case the developing unit 4 containing red or yellow toner is set, it is displayed that the simultaneous color mode is selected and also the colors thereof are displayed.

FIGS. 17(A) and 17(B) show; a flow chart showing the counter display processing routine.

Figure 17:
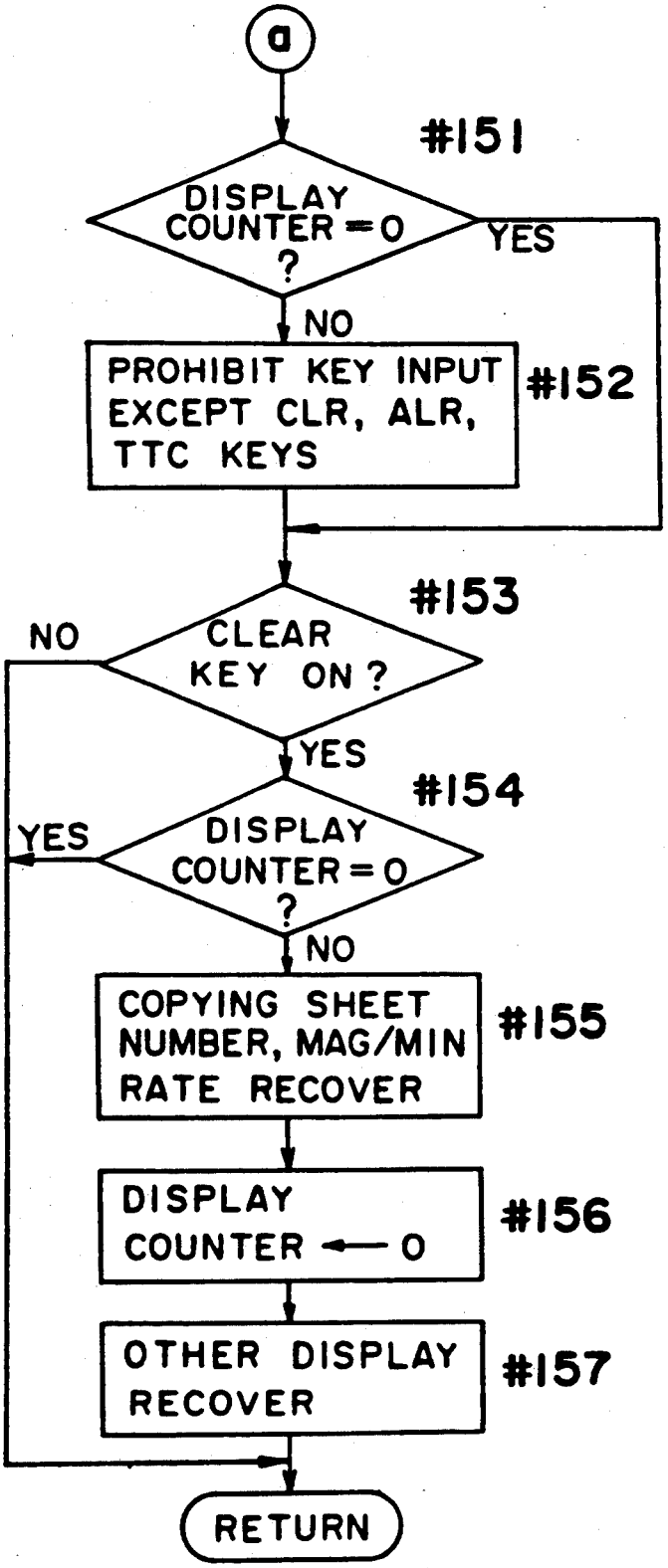

FIG. 17 shows the relative relationship between FIGS. 17(A) and 17(B).

In step #101, in the case that the total check key 96 is turned on (in case of 'Yes'), the program goes to step #102 and the content of the display counter, which is displayed with three bits, is checked whether it is '0' or not. In the case the value of the display counter is '0', the MAG/MIN rate display unit LED 73 displays the copying MAG/MIN rate and the sheet number display unit LED 72 displays the number of copying sheets. In the case that the value of the display counter is '1' to '3', each of the values of the various kinds of counters is displayed in the LED 72 and LED 73 extendedly.

As shown in FIG. 13, in the case that the value of the display counter is '1', the most significant figure displays the character 'A' and the rest six figures display the count value of the black copying operation showing the number of the copying sheets with black toner. In the case that the value of the display counter is '2', the most significant figure displays the character 'b' and the rest six figures display the count value of the red copying operation using red toner showing the number of the copying sheets with red toner. In the case that the value of the display counter is '3', the most significant figure displays the character 'c' and the rest six figures display the count of the yellow copying operation using yellow toner showing the number of the copying sheets with yellow toner. In the case that the value of the display counter is '4', the most significant figure displays the character 'd' and the rest six figures display the count value of the simultaneous color copying operation showing the number of the copying sheets with simultaneous color toner.

In the step #102, in the case the value of the display counter is '0' (i.e. in case of 'Yes' in the step #102), the value of the display counter is added by 1 in step #103, then the black copying count value using black toner is displayed in step #104, then the number of the copying sheets and the copying MAG/MIN rate, which have been previously displayed in the display units LED 72 and LED 73 are retired into a memory in step #105, and then all of the display units on the operation panel 70 except the display units LED 72 and LED 73 are turned off in step #106. Thus it becomes easy to read the display of the count value of the black copying operation with black toner.

On the other hand, in the case the value of the display counter is not '0' in the step #102 (i.e. in case of 'No' in step #102), the program goes to step #111 and it is judged whether or not the value of the display counter is '1', and in case of '1', the value of the display counter code is added by 1 in step #112, and the count value of the copying operation with red toner is displayed in step #113. In the similar way as described above, sequentially it is judged in step #121 whether or not the value of the display counter is '2', judged in step #131 whether or not the value of the display counter is '3', and in case of 'Yes', the values of the display counter are respectively increased one by one in steps #122 and #132, and then corresponding to the judged value of the display counter, the count value of the copying operation with yellow toner or the count value of the simultaneous color copying operation is displayed respectively in step #123 or #133.

In the case the value of the display counter is neither '0' to '3' when the total check key 96 is turned on, since the value of the display counter is '4', the value of the display counter is set '0' in step #141 and the number of the copying sheets and the copying MAG/MIN rate which have been previously retired into the memory are restored to be displayed in step #142, and at the same time the displays of other display units on the operation panel 70 are also recovered in step #143.

Next, in step #151 in the case the value of the display counter is not '0' (i.e. in case of 'No' in the step #151), the input operations of the keys other than the clearing stop key 91, the total check key 96 and the all reset key 98 are prohibited in step #152. Moreover, even though the various kinds of the count values are being displayed in step #154, when the clearing stop key 91 is turned on (in the case of 'Yes' in step #153), the copying MAG/MIN rate and the number of the copying sheets are recovered to be displayed in step #155, then the value of the display counter is set '0' in step #156 and the displays of the other display units on the operation panel 70 are also recovered in step #157.

Figure 18:
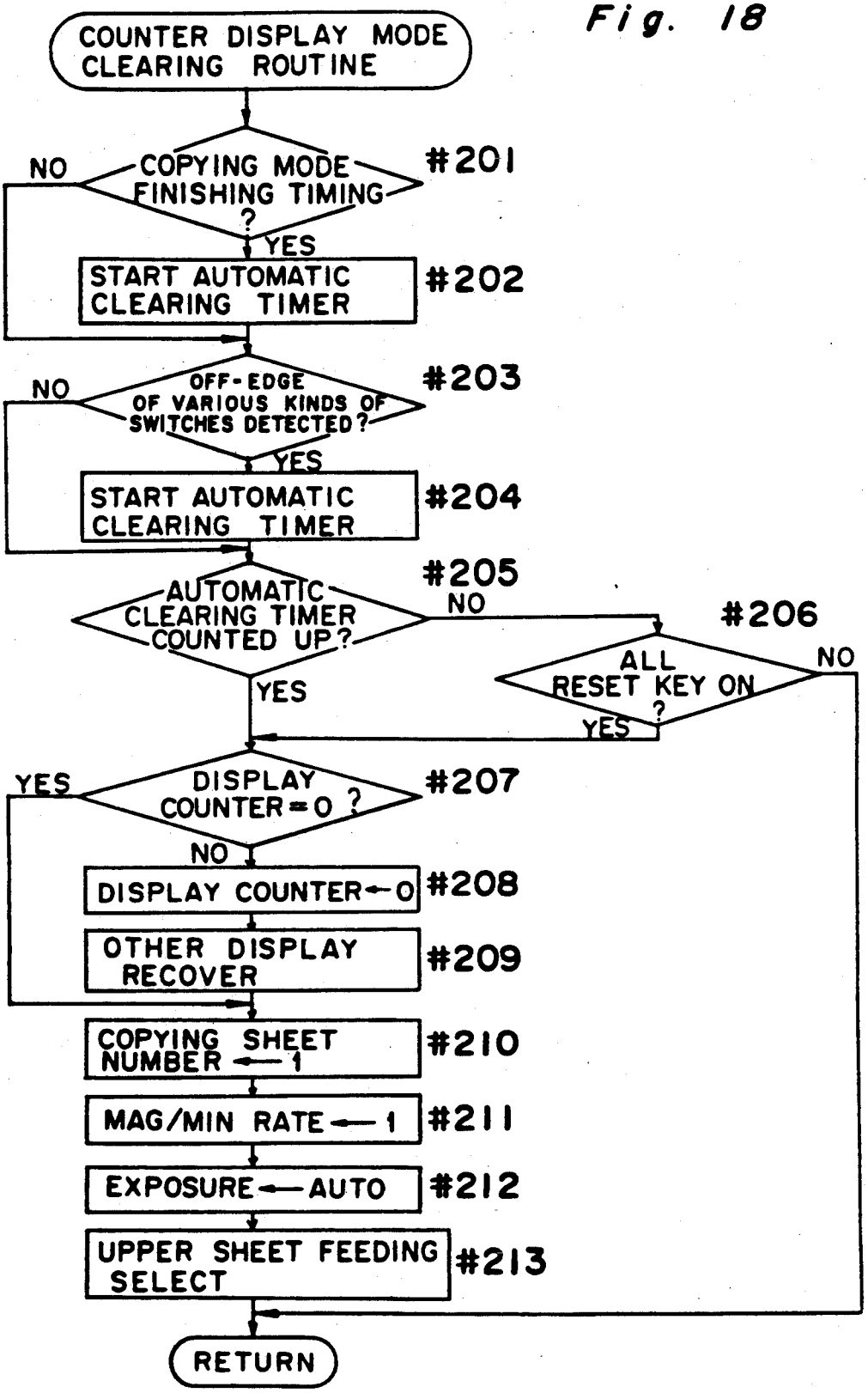

FIG. 18 shows a flow chart showing a counter display mode clearing routine.

When the signal representing the timing that of the copying mode is finished is detected in step #201 or the signal of the off-edge of the signals of the various kinds of the keys and switches on the operation panel 70 is detected in step #203 (i.e. in case of 'Yes' in step #201 or #203), the counting operation of the automatic clearing timer for resetting automatically is started in step #202 or #204.

Next, when the automatic clearing timer counts up (i.e. in case of 'Yes' in step #205) or when the all reset keys 98 are turned on (i.e. in case of 'Yes' in step #206), it is judged in step #207 whether or not the value of the display counter is set '0', and in the case the value of the display counter is not set '0' (i.e. in case of 'No' in the step #207), the value of the display counter is set '0' in step #208 and the other displays on the operation panel 70 are recovered in step #209.

Next in step #210, the number of the copying sheet is set '1' and the copying MAG/MIN rate is set to be equal in step #211, then the exposure operation is set in the automatic exposure in step #212 and the upper sheet feeding device 50 is selected in step #213 so as to set the various kinds of the copying conditions to be in the default values.

Figure 19:
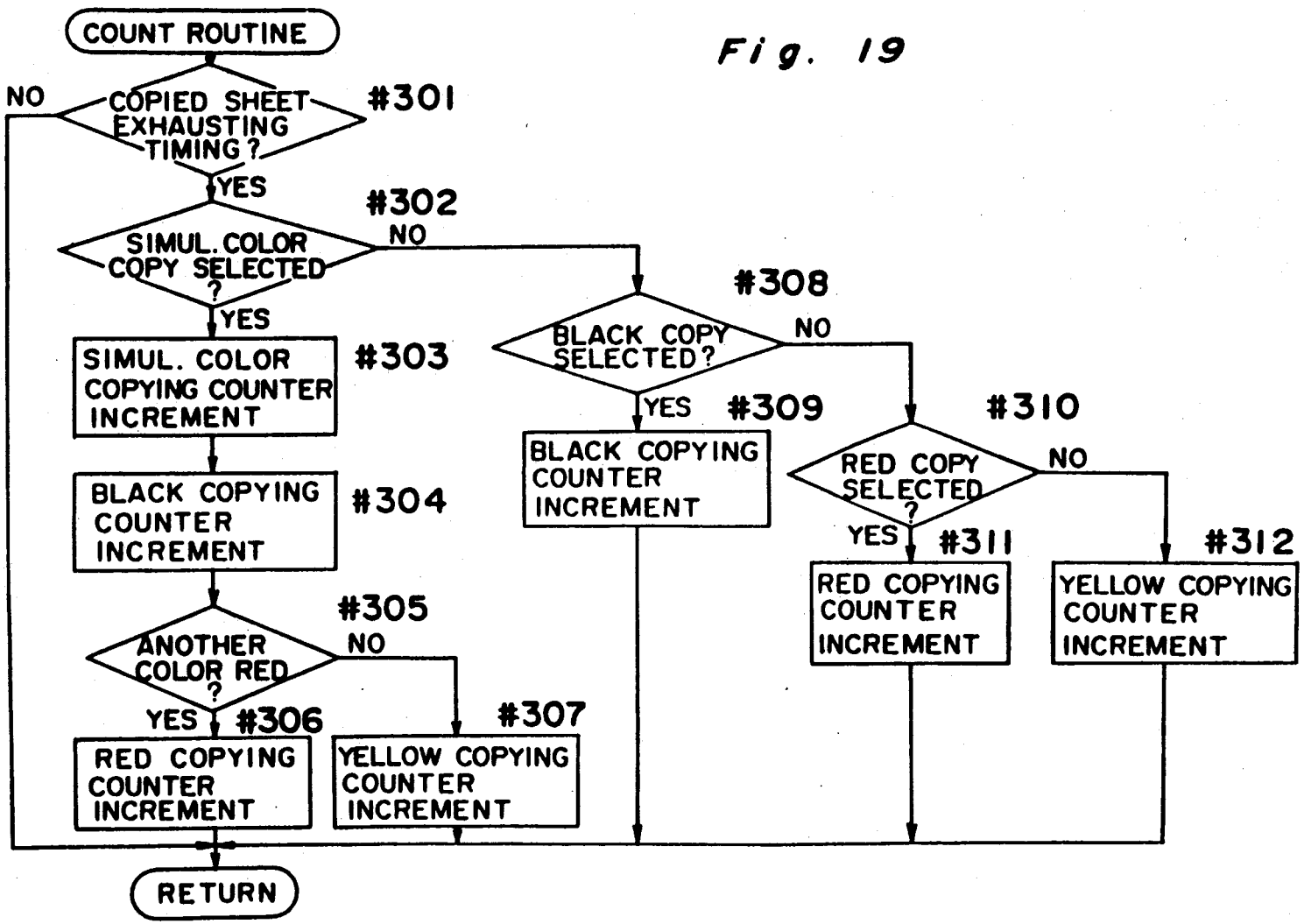

FIG. 19 shows a flow chart showing a count routine.

In the case the timing during which the copied sheet is discharged is set after finishing the copying operation onto the copying sheet (i.e. in the case of 'Yes' in step #301), it is judged in step #302 whether or not the simultaneous color copying mode is selected, and in the case the simultaneous color copying mode is not selected (i.e. in the case of 'No' in the step #302), the value of the copying counter corresponding to the color of the toner contained in the developing unit at that time is increased by 1 in steps #308 to #312.

In the case the simultaneous color copying mode is selected (i.e. in case of 'Yes' in the step #302), the values of the simultaneous color copying counter and the copying counter for black development are respectively increased by 1 in steps #303 and #304 and then the value of the copying counter for another color development judged in step #305 is increased by 1 in step #306 or #307.

In other words, in the case that the simultaneous color copying operation is executed, when the copying operation is finished and the copying sheet is fed out, the value of the simultaneous color copying counter is increased by 1 and the values of the two copying counters corresponding to the selected two kinds of toner colors (one of the two colors is black) are respectively increased by 1.

According to the embodiment described above, the LED 73 for displaying the MAG/MIN rate with four figures and the LED 72 for displaying the number of copied sheets with three figures are integrally arranged in one display unit. Therefore, it is possible to display various kinds of count values with seven figures so that the count values can be displayed having the kind of the counter which is now in use displayed in the most significant figure without a problem of lacking of the display figures.

Moreover, since the copying operation is unnecessary at the time of displaying the various kinds of the counter values, the displaying operations of the other display units on the operation panel 70 are stopped (i.e. the display units LED are turned off), so that the lighting MAG/MIN rate display unit LED 73 and the lighting sheet number display unit LED 72 can be seen integratedly so as to read the display thereof very easily in spite of having some distance between the two display units LED 72 and LED 73.

Moreover, according to the embodiment described above, when the simultaneous color copying operation is executed, since the copying counter for simultaneous color copying operation and each of the copying counters corresponding to the selected two kinds of toner colors are respectively operated by counting, the operation time of each of the developing units containing respectively black, red or yellow toner can be obtained and the operated times of the simultaneous color copying operation and of the other usual copying operation can be distinguished each other, that may be of great advantage to the maintenance of the developing unit and the charge calculation in the copying machine.

In this embodiment, though the developing color of toner is changed in turn from black through red or yellow color to black again during one time scanning operation the pattern of the color arrangement is not limited to this, and any image editing pattern can be made by changing the arrangement of the color developing units starting developing operation. Moreover, upon providing one lever, the developing color of toner may be changed only one time during the one time scanning operation, on the other hand, the number of the levers may be provided more than three.

In this embodiment, though the two developing units 4 and 5 are provided around the photoconductor drum 1 so as to enable to copy of two colors, in the present invention, three or four developing units may be provided around the photoconductor drum 1 so as to obtain three-colored or four-colored copy.

In the embodiment mentioned above, at the time of non-developing operation, although the developing motor 24 is stopped and the magnet roller 13 is rotated so as to retire the magnet pole from the developing area X1 to the position opposing to the head control member 19, it is not essential to move the position of the magnet pole between in the developing operation and in the non-developing operation as described above. However, in the case that the magnet pole is moved as mentioned above, the probability that the magnetic brushes contacts with the photoconductor drum 1 can be lowered to prevent undesired mixture of the colors.

In this embodiment, though the developing unit containing black toner is always used as the second developing unit 5 and the developing unit containing red or yellow toner is selectively used as the first developing unit 4 in the copying machine, the present invention is not limited to this and any two kinds of the developing units among the three kinds of developing units containing black, red or yellow toner respectively may be selectively used as the first and second developing units 4 and 5 so that the two colored image of red and yellow, for example, may be formed.

In the embodiment mentioned above, though the platen 9 is fixed and the exposure lamp 41 is scanned, the present invention is not limited to this and the exposure lamp 41 may be fixed and the platen 9 may be scanned.

Furthermore, in the embodiment mentioned above, though the various kinds of the copying counters are operated on the basis of the program performed by CPU, an electronic counter or an electro-magnetic counter made by hard logic may be adopted.

In this embodiment, though the color copying operation is performed by switching the developing units containing toners of different colors in one scanning operation, the present invention is not limited to this and may be adopted to an ordinary color copying machine in which a plurality of developing units are provided and a colored image is obtained by plural times of scanning operations.

According to the present invention, when the simultaneous color copy is performed, the counter is so arranged as to count each operation of each developing unit during one copying operation, the number of operation time of each of the developing units can be respectively obtained. Therefore, the maintenance of the copying machine such as exchange and supply of the toner can be made timely and correctly based on the content of the counter. Also the rental charge calculation of the copying machine can be properly made based on the content of the counter in the simultaneous color copying operation.

What is claimed is:

1. An image forming apparatus comprising:

forming means for forming an electrostatic latent image on a photosensitive member;

a developing station for developing the electrostatic latent image formed on the surface of the photosensitive member, including plural different kinds of the developing units;

processing means for selectively operating two developing units to form a double colored image;

determining means for determining whether or not the two developing units which are operated by said processing means contain the same developing color; and warning means for sending a warning when said detecting means detects that said two developing units have the same developing color.

2. An image forming apparatus according to claim 1, wherein said warning means comprises prohibiting means for prohibiting the operation of the processing means when said detecting means detects that said two developing units have the same developing color.

3. An image forming apparatus according to claim 2, wherein said warning means includes display means for displaying that the operation of the processing means is prohibited.

4. A copying machine comprising:

optical means for forming an electrostatic latent image of an original document to be copied on a photosensitive member by scanning the original document and exposing the image of the original document thus scanned;

developing means for developing the latent image on the photosensitive member, said developing means including a first developing unit and a second developing unit;

a first setting means for setting a first copying operation mode for developing the latent image on said photosensitive member by said second developing unit;

a second setting means for setting a second copying operation mode in which said latent image is developed in such a manner that said first developing unit and said second developing unit are alternately and sequentially operated in one scanning period to the optical means so that the latent image is developed with the developing colors of said first developing units and said second developing unit;

means for determining whether or not the color of said first developing unit and the color of said second developing unit are the same; and means for prohibiting the setting of the second copying operation mode when said determining means determines that both of the first and second developing units contain the same developing color.

5. A copying machine according to claim 4, wherein said first developing unit is removably attachable to a predetermined portion of a body of the copying machine so that one of a plurality of developing units having various developing colors can be attached to said predetermined portion of the copy machine body.

6. A copying machine according to claim 5, wherein said second developing unit is fixed to the body of the copying machine and is used for black color copying.

7. A copying machine according to claim 6, wherein said determining means determines whether or not the developer color used in said first developing unit attached to the predetermined portion of the copy machine body is black, and when the determining means determines that the developing color used in the first developing unit attached to the predetermined portion of the copy machine body is black, said determining means determines that the developing color of said first developing unit and the developing color of said second developing units are the same.

8. A copying machine comprising;

optical means for forming an electrostatic latent image of an original document to be copied on a photosensitive member by scanning the original document and exposing the image of the original document thus scanned;

first developing means for developing the latent image on the photosensitive member;

an attachment unit disposed adjacent to said first developing means for attaching second developing means which develops the latent image on the photosensitive member, said attachment unit being capable of accommodating the second developing means from a plurality of developing units with different developing colors;

means for determining the developing color of said second developing means attached to said attachment unit;

processing means for driving said first developing means and said second developing means in a predetermined period in one scanning period for developing the latent image on said photosensitive member with the developing color of said first developing means and second developing means to make a visible picture; and means for prohibiting the processing means when said determining means determines that both of the first and second developing means contain the same developing color.

9. The copying machine according to claim 8, further comprising means for displaying that said processing means is prohibited.

10. A copying machine comprising:

scan means for scanning an original document;

a photosensitive member for having an electrostatic latent image of the original document image scanned by said scan means on the surface thereof;

a developing station for developing the electrostatic latent image formed on the surface of the photosensitive member, including first and second developing units each containing developers;

mode selecting means for selecting one of a plurality of copy modes including a first copying mode in which the electrostatic image formed on the surface of the photosensitive member is developed by the first developing unit, a second copying mode in which the electrostatic latent image formed on the surface of the photosensitive member is developed by the second developing unit and a third copying mode in which the electrostatic latent image formed on the surface of the photosensitive member is developed by the first and the second developing units;

first process means for applying power to the first developing unit to form a single colored copying image when the first copying mode is selected by said mode selecting means;

second process means for applying power to the second developing unit to form a single colored copying image when the second copying mode is selected by said mode selecting means;

third process means for applying power to the first and the second developing units to form a double colored copying image when the third copying mode is selected by said mode selecting means;

determining means for determining whether or not the developing color of said first developing unit and the developing color of said second developing unit are the same; and prohibiting means for prohibiting the selection of the third copying mode when said determining means determines that both of the first and second developing units have the same developing color.

11. A copying machine according to claim 10, wherein said first developing unit is removably attachable to a predetermined portion of a body of the copying machine so that developing units having various developing colors can be attached to said predetermined portion of the copying machine body.

12. A copying machine according to claim 11, wherein said second developing unit is fixed to the body of the copying machine and is used for black color copying.

13. A copying machine according to claim 12, wherein said determining means determines whether or not the developing color used in said first developing unit attached to the predetermined portion of the copying machine body is black, and when the determining means determines that the developing color used in the developing unit attached to the predetermined portion of the copying machine body is black, said determining means determines that the developing color of said first developing unit and the developing color of said first developing unit are the same.

14. A copying machine comprising:

scan means for scanning an original document;

a photosensitive member for having an electrostatic latent image of the original document image scanned by said scan means on the surface thereof;

a developing station for developing the electrostatic latent image formed on the surface of the photosensitive member, including first and second developing units;

mode selecting means for selecting a first copying mode and a second copying mode, wherein the electrostatic image formed on the surface of the photosensitive member is developed by one of the first and second developing units in the first copying mode and the electrostatic latent image formed on the surface of the photosensitive member is developed by both the first and the second developing units in the second copying mode;

indicating means for indicating a scanning area in the scanning direction of the original document to be scanned by the scan means;

first process means for applying power to the first developing unit to form a single colored copying image when the first copying mode is selected by said mode selecting means;

second process means for switching the first and the second developing units to a power applied condition or to a power non-applied condition corresponding to the area indicated by the indicating means to form a double colored copying image during a one time copying operation of the scan means when the second copying mode is selected by said mode selecting means;

determining means for determining whether or not the developing color of said first developing unit and the developing color of said second developing unit are the same; and prohibiting means for prohibiting the selection of the second copying mode when said determining means determines that both of the first and second developing units have the same developer color.

15. A copying machine according to claim 14 further comprising means for displaying that said processing means is prohibited.

16. A copying machine comprising:

scan means for scanning an original document;

a photosensitive member for having an electrostatic latent image of the original document image scanned by said scan means on the surface thereof;

a first developing means for developing the electrostatic latent image formed on the surface of the photosensitive member with color of a developer contained in a first developing unit to form a visible image on the surface of the photosensitive member under the operating condition thereof;

a second developing means for developing the electrostatic latent image formed on the surface of the photosensitive member with color of a developer contained in a second developing unit to form a visible image on the surface of the photosensitive member under the operating condition thereof;

indicating means for indicating a scanning area in the scanning direction of the original document to be scanned by the scan means;

process means for switching the first and the second developing means into an operating condition or non-operating condition to form a double colored image in a one time scanning operation of the scan means on the basis of the area indicated by said indicating means;

determining means for determining whether or not the color of the developer contained in said first developing unit and the color of the developer contained in said second developing unit are the same; and prohibiting means for prohibiting the process means for switching the first and the second developing means into an operating condition in order to form a double colored image when said determining means determines that both of the first and second developing units have the same developing color.

17. A copying machine according to claim 16, including means for displaying that said process means is prohibited.

* * * * *